US007587961B1

(12) United States Patent
Chiang

(10) Patent No.: US 7,587,961 B1
(45) Date of Patent: Sep. 15, 2009

(54) REVERSIBLE RATCHET TOOL

(75) Inventor: Shui-Lai Chiang, Taichung (TW)

(73) Assignee: William Tools Co., Ltd., Taichung (TW)

( * ) Notice: Subject to any disclaimer, the term of this patent is extended or adjusted under 35 U.S.C. 154(b) by 0 days.

(21) Appl. No.: 12/228,359

(22) Filed: Aug. 11, 2008

(51) Int. Cl.
*B25B 13/46* (2006.01)

(52) U.S. Cl. ..... 81/62; 81/60

(58) Field of Classification Search ..... 81/60–63.2
See application file for complete search history.

(56) References Cited

U.S. PATENT DOCUMENTS

| | | | | |
|---|---|---|---|---|
| 294,282 | A * | 2/1884 | Sinclair | 81/62 |
| 2,107,568 | A * | 2/1938 | Haist | 81/62 |
| 4,873,898 | A | 10/1989 | Chern | |
| 5,174,176 | A | 12/1992 | Krivec | |
| 5,499,559 | A | 3/1996 | Lin | |
| 5,622,089 | A | 4/1997 | Gifford, Sr. | |
| 6,279,428 | B1 * | 8/2001 | Huang | 81/63.1 |
| 2008/0229887 | A1 * | 9/2008 | Thompson et al. | 81/62 |
| 2008/0229889 | A1 * | 9/2008 | Hopper et al. | 81/63.1 |

* cited by examiner

*Primary Examiner*—Hadi Shakeri
(74) *Attorney, Agent, or Firm*—Charles E. Baxley

(57) ABSTRACT

A reversible ratchet tool includes a rotary member received in a housing and having a number of teeth, a cover secured to the housing and having three depressions located around an axle, two pawl members mounted in the housing and each having one or more teeth for being biased to engage with the rotary member, an actuating member pivotally attached to the axle and having a projection for engaging with either of the depressions of the cover, and a hand grip coupled to the actuating member for actuating the actuating member to engage with the pawl members and to control the rotating direction of the rotary member by the housing, and for allowing the rotary member to be rotated in both directions by the housing selectively.

3 Claims, 7 Drawing Sheets

REVERSIBLE RATCHET TOOL

BACKGROUND OF THE INVENTION

1. Field of the Invention

The present invention relates to a reversible ratchet tool, and more particularly to a reversible ratchet tool including a control pawl device for controlling the driving or rotating direction of the reversible ratchet tool, and for allowing reversible ratchet tool to be selectively driven or rotated in either of the directions or in both directions by the user.

2. Description of the Prior Art

Typical reversible ratchet tools comprise a cylindrical block rotatably received in a post compartment of a head portion of a handle, and a number of posts engaged between the cylindrical block and the head portion of the handle, and a lever switch coupled to the posts with a post plate for actuating the posts to be engaged in the selected position between the cylindrical block and the head portion of the handle, and for controlling the driving or rotating direction of the cylindrical block with the head portion of the handle.

For example, U.S. Pat. No. 4,873,898 to Chern discloses one of the typical ratchetless reversible wrenches also comprising a number of posts engaged between a cylindrical block and a head portion of a handle, and a lever switch coupled to the posts with a post plate for actuating the posts to be engaged in the selected position between the cylindrical block and the head portion of the handle, and for controlling the driving or rotating direction of the cylindrical block.

However, the driving or rotating direction of the cylindrical block by the head portion of the handle may only be reversed, or may only be driven or rotated in either of the directions, but may not be driven or rotated in both directions with the head portion of the handle by the user.

U.S. Pat. No. 5,174,176 to Krivec discloses another typical reversible ratchet wrench comprising a ratchet wheel rotatably received in a housing, and a reversing pawl unit including two pawls connected to a pivotally mounted reversing cam by leaf springs.

However, similarly, the driving or rotating direction of the ratchet wheel by a housing of the handle may only be reversed, but may not be driven or rotated in both directions with the housing by the user.

U.S. Pat. No. 5,499,559 to Lin discloses a further typical reversible ratchet or socket wrench comprising an adapter rotatably received in an adapter holder, and a number of roller bearings engaged between the adapter and the adapter holder for controlling the driving or rotating direction of the adapter.

However, similarly, the driving or rotating direction of the adapter by the adapter housing may only be reversed, but may not be driven or rotated in both directions with the adapter housing by the user.

U.S. Pat. No. 5,622,089 to Gifford, Sr. discloses a still further typical reversible ratchet wrench comprising a large circular gear rotatably received in an outboard section of a circular shaped head, and two bevel arms disposed in an inboard section of the circular shaped head, and an upstanding biasing member having a triangular configuration with rounded edges and disposed between the two bevel arms for actuating the bevel arms to selectively engage with the circular gear and for controlling the driving or rotating direction of the circular gear.

However, similarly, the driving or rotating direction of the circular gear may only be reversed, but may not be driven or rotated in both directions with the handle by the user.

The present invention has arisen to mitigate and/or obviate the afore-described disadvantages of the conventional reversible ratchet tools.

SUMMARY OF THE INVENTION

The primary objective of the present invention is to provide a reversible ratchet tool including a control pawl device for controlling the driving or rotating direction of the reversible ratchet tool, and for allowing reversible ratchet tool to be selectively driven or rotated in either of the directions or to be selectively driven or rotated in both directions by the user.

In accordance with one aspect of the invention, there is provided a reversible ratchet tool comprising a housing including a chamber and a compartment formed in the housing and communicating with each other, and including two curved recesses formed therein and communicating with the compartment of the housing, and including an orifice formed therein and communicating with the compartment of the housing, a rotary member rotatably received in the chamber of the housing and including a driving stem extended outwardly therefrom, and including a number of teeth provided on an outer peripheral portion thereof, and a cover secured to the housing for closing the chamber and the compartment of the housing, and including an opening formed therein for receiving the driving stem of the rotary member and for allowing the driving stem of the rotary member to be extended out through the opening of the cover and to be extended out of the housing, the cover including an axle extended therefrom and including three depressions formed therein and located and arranged around the axle, two pawl members received and engaged in the compartment of the housing, and each including a rounded end pivotally engaged in the curved recesses of the housing for pivotally mounting the pawl members to the housing, and each including at least one tooth formed on another end portion thereof for selectively engaging with the teeth of the rotary member, two spring members disposed in the compartment of the housing and engaged with the pawl members for biasing the pawl members to engage with the teeth of the rotary member respectively, an actuating member received in the compartment of the housing, and including a cavity formed therein for pivotally receiving the axle of the cover and for pivotally securing the actuating member in the housing, and including a projection extended from the actuating member for engaging with either of the depressions of the cover and for positioning the actuating member to the housing at the selected positions, and a hand grip rotatably engaged with the orifice of the housing and coupled to the actuating member for rotating the actuating member relative to the housing and for actuating the actuating member to selectively engage with the pawl members, and the actuating member is rotated relative to the housing and the cover with the hand grip to engage with either of the pawl members and to disengage either of the pawl members from the rotary member and for allowing the rotary member to be rotated in either direction by the housing, and both of the pawl members being biased and forced to engage with the teeth of the rotary member for allowing the rotary member to be rotated in both directions by the housing when the actuating member is centered and is not rotated relative to the housing and the cover and is not engaged with both of the pawl members.

The hand grip includes an aperture formed therein for slidably receiving a free end portion of the actuating member, and the actuating member includes a hole formed therein for receiving a spring element, and the spring element is engaged between the actuating member and the hand grip and biases the projection of the actuating member to engage with either of the depressions of the cover and for positioning the actuating member to the housing at the selected positions.

The rotary member includes a detent slidably received in the driving stem of the rotary member, and includes a control device slidably engaged into the rotary member and engaged with the detent for actuating the detent to selectively move out of the driving stem of the rotary member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
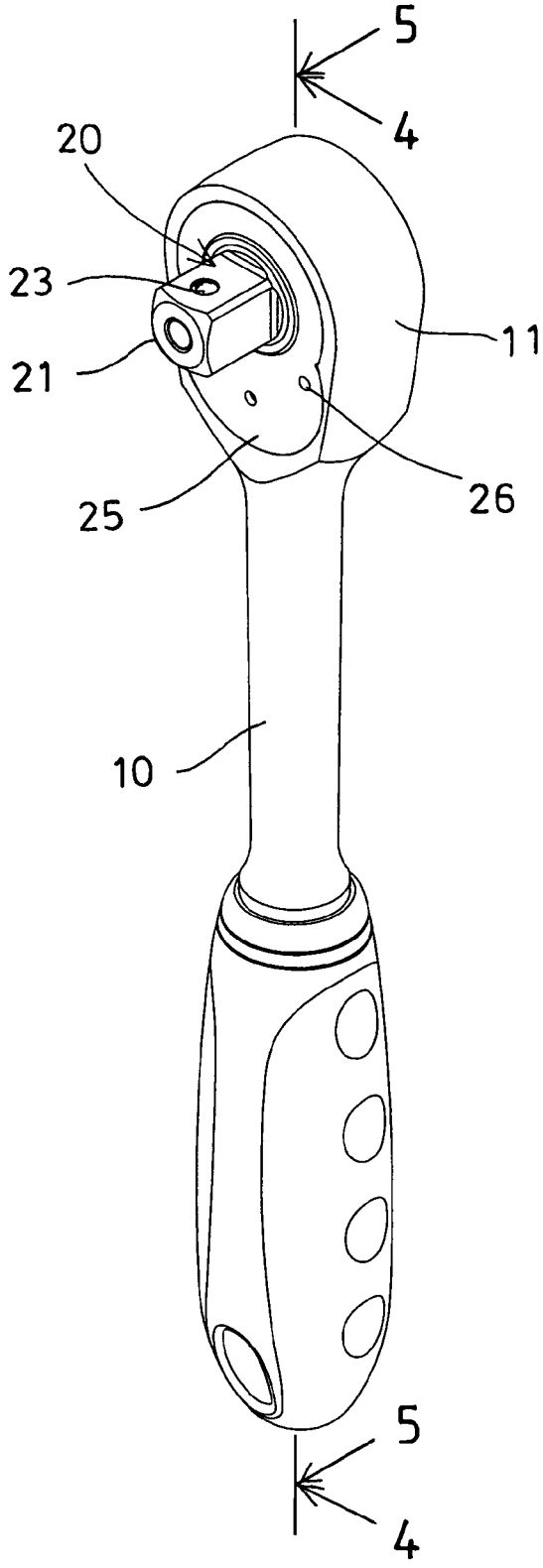
FIG. 1 is a perspective view of a reversible ratchet tool in accordance with the present invention.

Referring to the drawings, and initially to FIGS. 1-5, a reversible ratchet tool in accordance with the present invention comprises a handle 10 including a head or housing 11 formed or provided on one end portion thereof, and including a chamber 12 and a compartment 13 formed in the housing 11 and communicating with each other, a wheel gear or rotary member 20 is rotatably received in the chamber 12 of the housing 11 and includes a driving stem 21 extended outwardly therefrom, and includes a number of teeth 22 formed or provided on the outer peripheral portion thereof, and includes a detent 23 slidably received in the driving stem 21 of the rotary member 20, and includes a control device 24 slidably engaged into the rotary member 20 and engaged with the detent 23 for actuating the detent 23 to selectively move out of the driving stem 21 of the rotary member 20 and for forcing or actuating the detent 23 to selectively engage with a driven member (not shown) and to detachably attach or secure or couple the driven member to the driving stem 21 of the rotary member 20.

A cap or cover 25 is attached to the housing 11 and secured to the housing 11 with one or more (such as two) fasteners 26 for blocking or closing the chamber 12 and the compartment 13 of the housing 11, and includes an opening 27 formed therein for receiving the driving stem 21 of the rotary member 20 and for allowing the driving stem 21 of the rotary member 20 to be extended out through the opening 27 of the cover 25 and to be extended out of the housing 11 for engaging with the driven member. The cover 25 further includes an axle 28 extended therefrom (FIG. 3), and includes one or more (such as three) depressions 29 formed therein and located or arranged around the axle 28. The housing 11 includes two curved recesses 14 formed therein and communicating with the compartment 13 of the housing 11, and includes an orifice 15 formed therein and also communicating with the compartment 13 of the housing 11.

Two pawl members 30 are received or engaged in the compartment 13 of the housing 11, and each include a rounded end 31 pivotally or rotatably received or engaged in the curved recesses 14 of the housing 11 for pivotally or rotatably attaching or mounting the pawl members 30 to the housing 11, and each include one or more teeth 32 formed or provided on the other end portion thereof for selectively engaging with the teeth 22 of the rotary member 20 (FIGS. 5-7) and for controlling the driving or rotating direction of the rotary member 20 by the housing 11 of the handle 10. One or more (such as two) spring members 33 are disposed or received or engaged in the compartment 13 of the housing 11 and engaged with the pawl members 30 respectively for biasing or forcing the pawl members 30 to engage with the teeth 22 of the rotary member 20 respectively.

An operating or actuating device or control pawl device 5 includes a post or cam or actuating member 50 received or engaged in the compartment 13 of the housing 11, and includes a cavity 51 formed or provided in one end portion of the actuating member 50 for pivotally or rotatably attaching or receiving the axle 28 of the cover 25 and for pivotally or rotatably attaching or securing the actuating member 50 in the housing 11, and includes a projection 52 extended from the actuating member 50 for engaging with either of the depressions 29 of the cover 25 and for anchoring or positioning the actuating member 50 to the housing 11 at the predetermined or selected positions. A knob or hand grip 53 is pivotally or rotatably engaged with the orifice 15 of the housing 11, and attached or secured or coupled to the actuating member 50 for rotating the actuating member 50 relative to the housing 11 and for operating or actuating the actuating member 50 to selectively engage with the pawl members 30.

Figure 2:
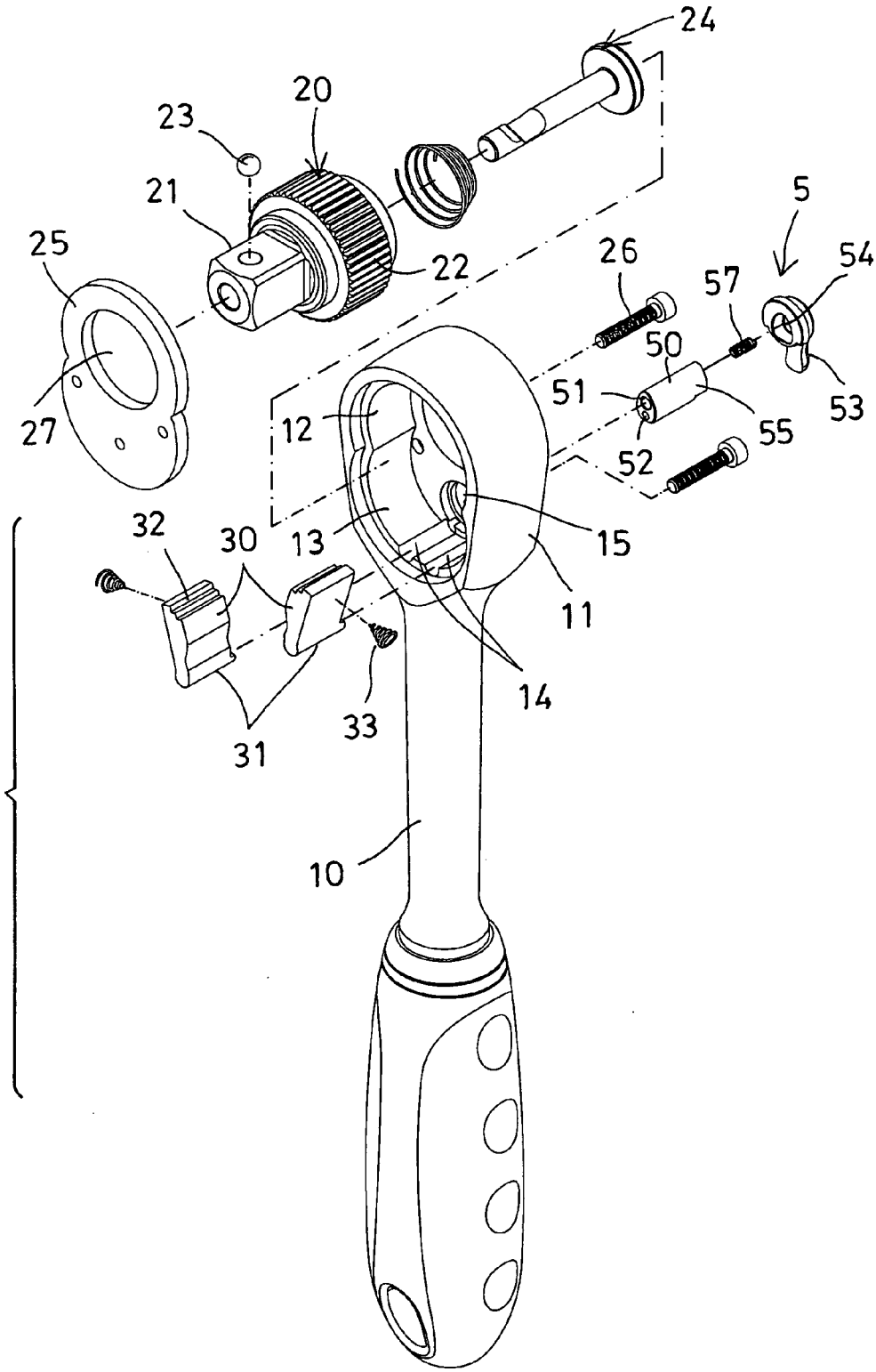
FIG. 2 is a partial exploded view illustrating a portion of the reversible ratchet tool.
Figure 3:
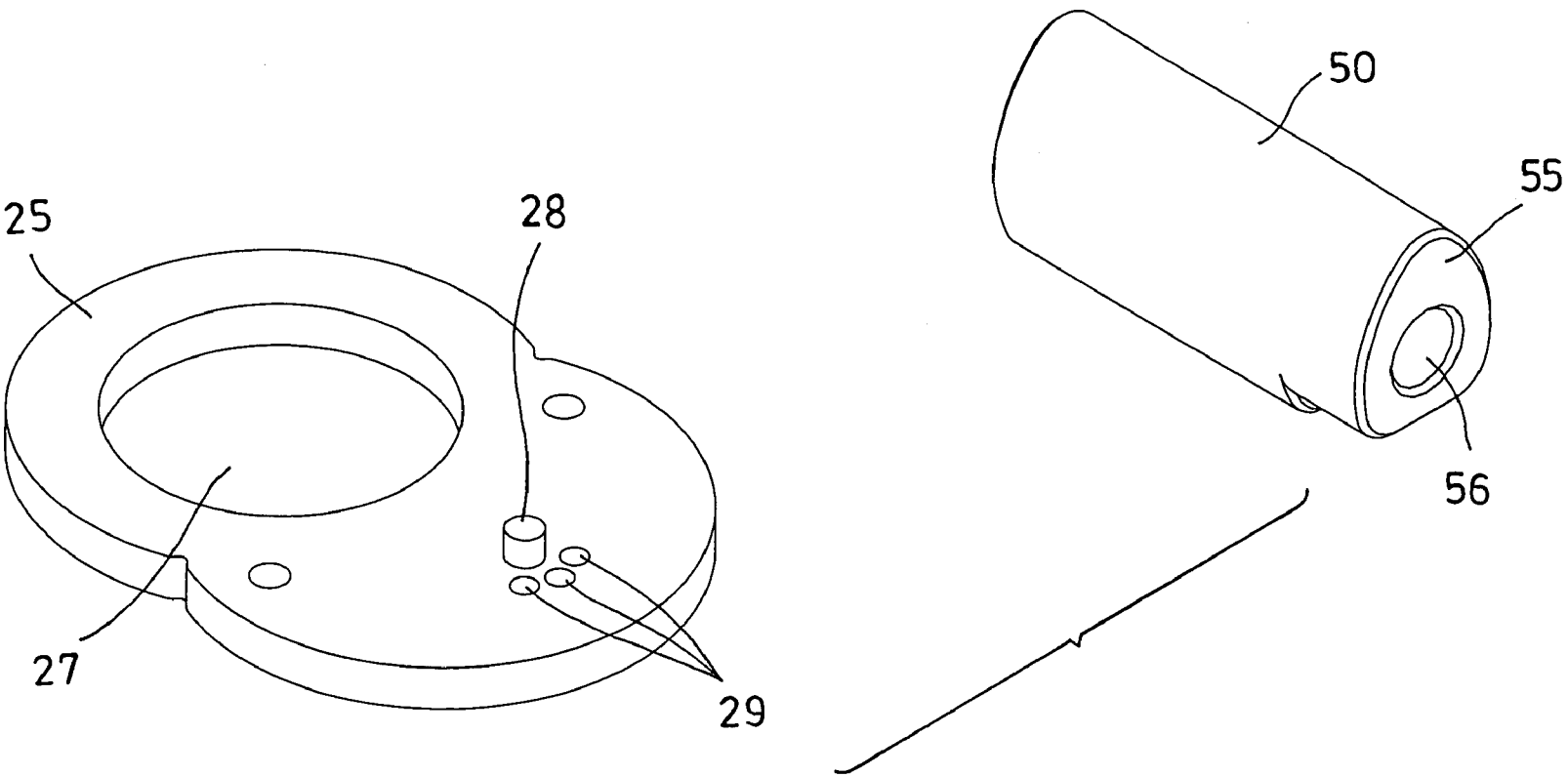
FIG. 3 is a further partial exploded view of the reversible ratchet tool.
Figure 4:
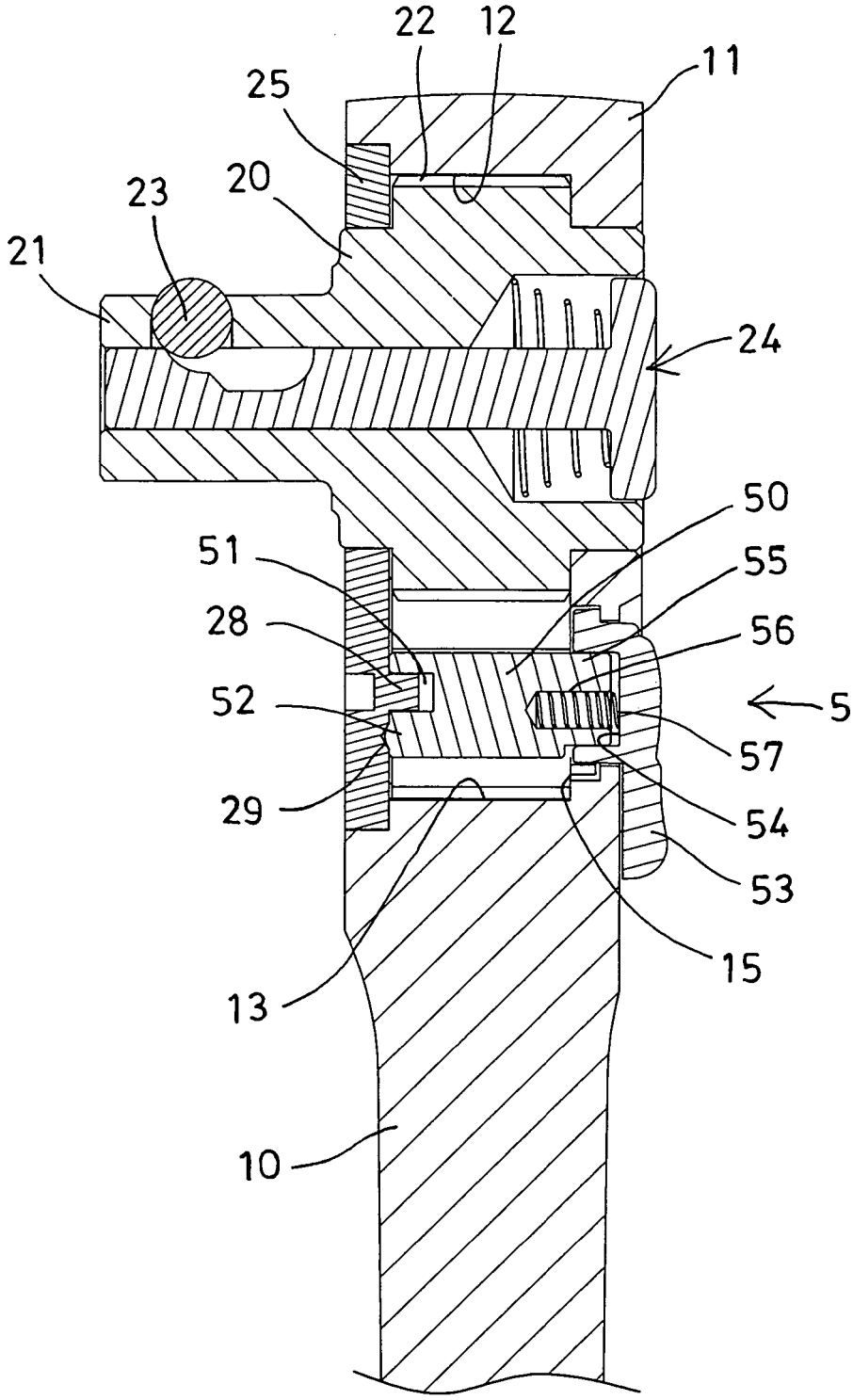
FIGS. 4, 5 are cross sectional views of the reversible ratchet tool taken along lines 4-4, and 5-5 of FIG. 1 respectively.
Figure 5:
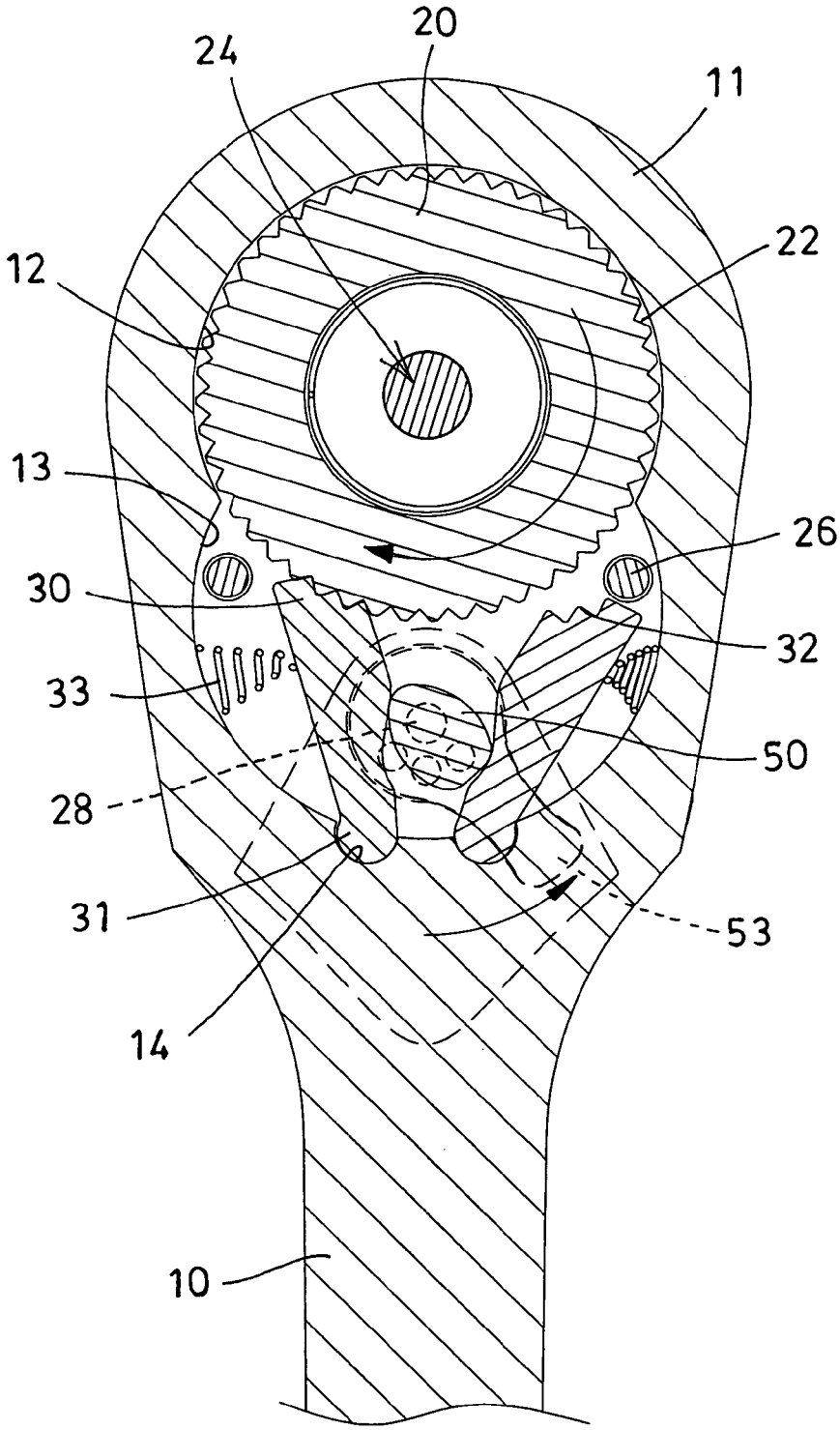
Figure 6:
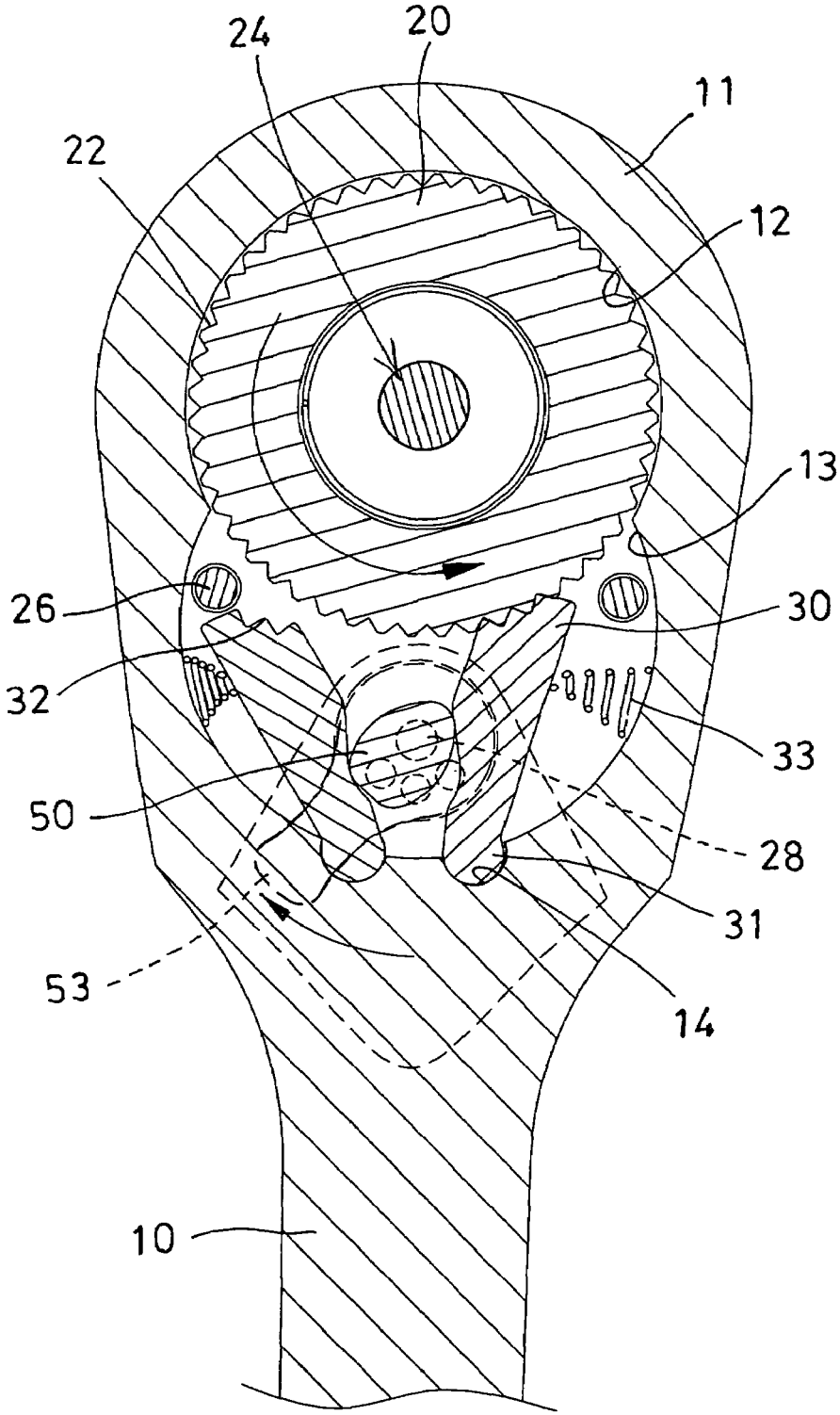
FIGS. 6, 7 are cross sectional views similar to FIG. 5, illustrating the operation of the control pawl device of the reversible ratchet tool.
Figure 7:
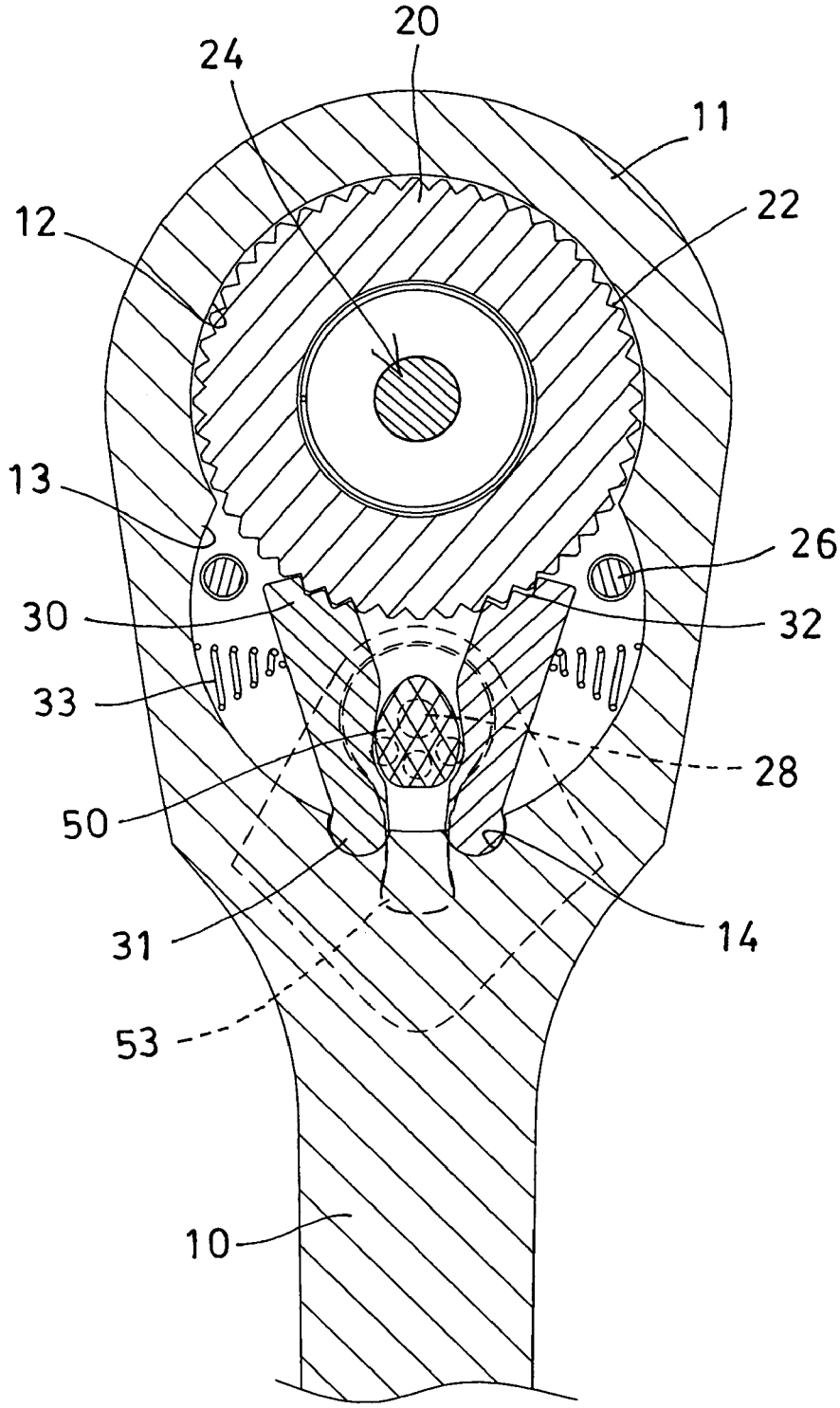

As best shown in FIGS. 2-4, the hand grip 53 includes an aperture 54 formed therein for slidably receiving or engaging with a free end portion 55 of the actuating member 50, and the actuating member 50 includes a hole 56 formed therein for receiving a spring element 57 which is engaged between the actuating member 50 and the hand grip 53 and which may bias or force the projection 52 of the actuating member 50 to selectively engage with either of the depressions 29 of the cover 25 and for anchoring or positioning the actuating member 50 to the housing 11 at the predetermined or selected positions. As shown in FIGS. 5-7, the actuating member 50 includes a substantially rounded triangular cross section for engaging with and for disengaging either of the pawl members 30 from the rotary member 20 (FIGS. 5, 6) when the actuating member 50 is rotated relative to the housing 11 and the cover 25, and arranged for allowing both of the pawl members 30 to engage with the rotary member 20 (FIG. 7) when the actuating member 50 is centered or is not rotated relative to the housing 11 and the cover 25.

In operation, as shown in FIG. 4, the actuating member 50 may be rotated relative to the housing 11 and the cover 25 with the hand grip 53 to engage with one of the pawl members 30 and to disengage the right pawl member 30 from the rotary member 20 (FIG. 5) for allowing the rotary member 20 to be driven or rotated clockwise by the housing 11 of the handle 10. On the contrary, as shown in FIG. 6, when the left pawl member 30 is disengaged from the rotary member 20 by the actuating member 50, the rotary member 20 may be driven or rotated counterclockwise by the housing 11 of the handle 10. As shown in FIG. 7, when the actuating member 50 is centered or is not rotated relative to the housing 11 and the cover 25 and is not engaged with both of the pawl members 30, both of the pawl members 30 may be biased or forced to engage with the teeth 22 of the rotary member 20 respectively for allowing the rotary member 20 to be driven or rotated in both directions by the housing 11 of the handle 10.

Accordingly, the reversible ratchet tool in accordance with the present invention includes a control pawl device for controlling the driving or rotating direction of the reversible ratchet tool, and for allowing reversible ratchet tool to be selectively driven or rotated in either of the directions or to be selectively driven or rotated in both directions by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A reversible ratchet tool comprising:

a housing including a chamber and a compartment formed in said housing and communicating with each other, and including two curved recesses formed therein and communicating with said compartment of said housing, and including an orifice formed therein and communicating with said compartment of said housing, a rotary member rotatably received in said chamber of said housing and including a driving stem extended outwardly therefrom, and including a plurality of teeth provided on an outer peripheral portion thereof, a cover secured to said housing for closing said chamber and said compartment of said housing, and including an opening formed therein for receiving said driving stem of said rotary member and for allowing said driving stem of said rotary member to be extended out through said opening of said cover and to be extended out of said housing, said cover including an axle extended therefrom and including three depressions formed therein and located and arranged around said axle, two pawl members received and engaged in said compartment of said housing, and each including a rounded end pivotally engaged in said curved recesses of said housing for pivotally mounting said pawl members to said housing, and each including at least one tooth formed on another end portion thereof for selectively engaging with said teeth of said rotary member, two spring members disposed in said compartment of said housing and engaged with said pawl members for biasing said pawl members to engage with said teeth of said rotary member respectively, an actuating member received in said compartment of said housing, and including a cavity formed therein for pivotally receiving said axle of said cover and for pivotally securing said actuating member in said housing, and including a projection extended from said actuating member for engaging with either of said depressions of said cover and for positioning said actuating member to said housing at said selected positions, and a hand grip rotatably engaged with said orifice of said housing and coupled to said actuating member for rotating said actuating member relative to said housing and for actuating said actuating member to selectively engage with said pawl members, and said actuating member being rotated relative to said housing and said cover with said hand grip to engage with either of said pawl members and to disengage either of said pawl members from said rotary member and for allowing said rotary member to be rotated in either direction by said housing, and both of said pawl members being biased and forced to engage with said teeth of said rotary member for allowing said rotary member to be rotated in both directions by said housing when said actuating member is centered and is not rotated relative to said housing and said cover and is not engaged with both of said pawl members.

2. The reversible ratchet tool as claimed in claim 1, wherein said hand grip includes an aperture formed therein for slidably receiving a free end portion of said actuating member, and said actuating member includes a hole formed therein for receiving a spring element, and said spring element is engaged between said actuating member and said hand grip and biases said projection of said actuating member to engage with either of said depressions of said cover and for positioning said actuating member to said housing at the selected positions.

3. The reversible ratchet tool as claimed in claim 1, wherein said rotary member includes a detent slidably received in said driving stem of said rotary member, and includes a control device slidably engaged into said rotary member and engaged with said detent for actuating said detent to selectively move out of said driving stem of said rotary member.

* * * * *